United States Patent [19]

Kawamura et al.

[11] Patent Number: 4,506,145

[45] Date of Patent: Mar. 19, 1985

[54] DEVICE FOR CONTROLLING ENGINE PREHEATING

[75] Inventors: Hideo Kawamura; Isamu Otsubo; Tsutomu Kitagawa, all of Kanagawa, Japan

[73] Assignee: Isuzu Motors Ltd., Tokyo, Japan

[21] Appl. No.: 447,370

[22] Filed: Dec. 6, 1982

Related U.S. Application Data

[63] Continuation-in-part of Ser. No. 400,525, Jul. 21, 1982, abandoned, which is a continuation of Ser. No. 51,289, Jun. 22, 1979, abandoned.

[30] Foreign Application Priority Data

Jul. 10, 1978 [JP] Japan ..... 53/83731

[51] Int. Cl.[3] ..... H05B 1/02

[52] U.S. Cl. ..... 219/499; 219/505; 219/202; 219/205; 219/519; 123/179 H

[58] Field of Search ..... 219/202, 203, 494, 497, 219/499, 501, 508, 514, 505, 205, 519; 123/179 B, 179 H

[56] References Cited

U.S. PATENT DOCUMENTS 4,196,712 4/1980 Kawamura et al. ..... 219/499

4,258,678 3/1981 Abe ..... 219/514

*Primary Examiner*—M. H. Paschall

*Attorney, Agent, or Firm*—Sughrue, Mion, Zinn, Macpeak and Seas

[57] ABSTRACT

An apparatus for controlling the preheating of a diesel engine in which a preheating plug is rapidly brought to starting temperature so that the engine be substantially instantaneously started. Each preheating plug in each of the cylinders of the engine has a heater body having a resistance which varies with temperature changes but which is sufficiently small that the heater body would melt if a predetermined rated voltage were continuously applied thereto. When the starter switch of the engine is in the engine accessory position, so long as the detected temperature of the heater body is below an upper preheating temperature, the rated voltage is applied directly to the heater body. When the temperature of the heater body reaches the upper temperature, the heater body is disconnected from the battery. In the engine starting position of the starter switch, the quick heating circuit is disconnected and the heater body is coupled to the battery through a stabilizer resistor.

8 Claims, 2 Drawing Figures

DEVICE FOR CONTROLLING ENGINE PREHEATING

This is a continuation-in-part Ser. No. 400,525, filed July 21, 1982, abandoned, which is a continuation of application Ser. No. 51,289 filed June 22, 1979, now abandoned.

BACKGROUND OF THE INVENTION

The present invention relates to an apparatus for assisting the starting of a diesel engine employing preheating glow plugs.

It is known to provide preheating plugs in combustion chambers and to heat the preheating plugs until they are red-hot for enhancing the starting of a diesel engine.

In a conventional starting assistance apparatus, a current is passed through the preheating plugs to heat them when a key-operated switch is in an engine starting position. The interval of time before the engine can be started can be reduced by passing a large current through the preheating plugs to make them red-hot at a rapid rate. However, there is a tendency for the heater bodies of the preheating plugs to melt if such a large current is employed, and hence such an arrangement cannot be put to practical use. The prior apparatus, which does not use such a large current, is thus disadvantageous in that it takes about 20 to 30 seconds before preheating can be completed, that is, before the preheating plugs can be heated to a suitable temperature of about 900° C.

Another known apparatus, which is described in West German Offenlegungsschrift No. 1,426,173, includes ignition plugs (preheating plugs) incorporating a heater body having a resistance which increases with rising temperature, with the ignition plugs being connected as resistors in a Wheatstone bridge. When a current passes through the ignition plugs, diametrically opposite terminals of the Wheatstone bridge are brought out of balance. This generates a voltage which is used to cause a control transistor to energize or de-energize a power switch control relay, thereby inserting or shunting a control resistor with the ignition plugs to maintain the ignition plugs at a constant temperature. Such an apparatus includes a device for turning on and off a current through the ignition plugs with a switching element to heat the ignition plugs at a constant temperature. This apparatus is used for ignition plugs for igniting a heater mechanism in a bus having an internal combustion engine, a jet propulsion system using liquid fuel, and the like. Since the ignition plugs are required to be maintained at a constant temperature for a long period of time, the heater bodies must have a resistance large enough for them not to be melted when a rated voltage is continuously applied. Hence, if such ignition plugs are incorporated in a starting assistance apparatus for a diesel engine, they also require 20 to 30 seconds to get the engine started after the key-operated switch has been set in the engine starting position. Thus, such a prior apparatus is advantageous only in applications where the temperature of the ignition plugs is to be maintained constant over a relatively long time period.

It is an object of the present invention to provide an apparatus for assisting the start of a diesel engine substantially immediately upon a key-operated switch being set to an engine starting position.

SUMMARY OF THE INVENTION

In accordance with this and other objects of the invention, there is provided an apparatus for controlling the preheating of a diesel engine in which a preheating plug disposed in each of the cylinders of the engine is very rapidly heated to a starting temperature so that the engine can be substantially instantaneously started. Each preheating plug has a heater body having a resistance which is variable with temperature, at least in the vicinity of predetermined upper and lower preheating temperatures. The resistance of the heater body is small enough that the heater body would melt if a predetermined rated voltage were continuously applied thereto. A control circuit detects when a heater body reaches the predetermined upper temperature. When the starter switch of the engine is in the accessory energizing position, a quick heating circuit connects the heater body to the battery when the control circuit detects the temperature of the heater body as being below the predetermined upper temperature and disconnects the heater body otherwise. When the starter switch is placed in the engine starting position, a lower voltage is applied to the heater body through a stabilizer circuit including a resistor to maintain the temperature of the heater body.

DESCRIPTION OF THE PREFERRED EMBODIMENTS

A preferred embodiment of the present invention will now be described in detail with reference to the drawings.

Figure 1:
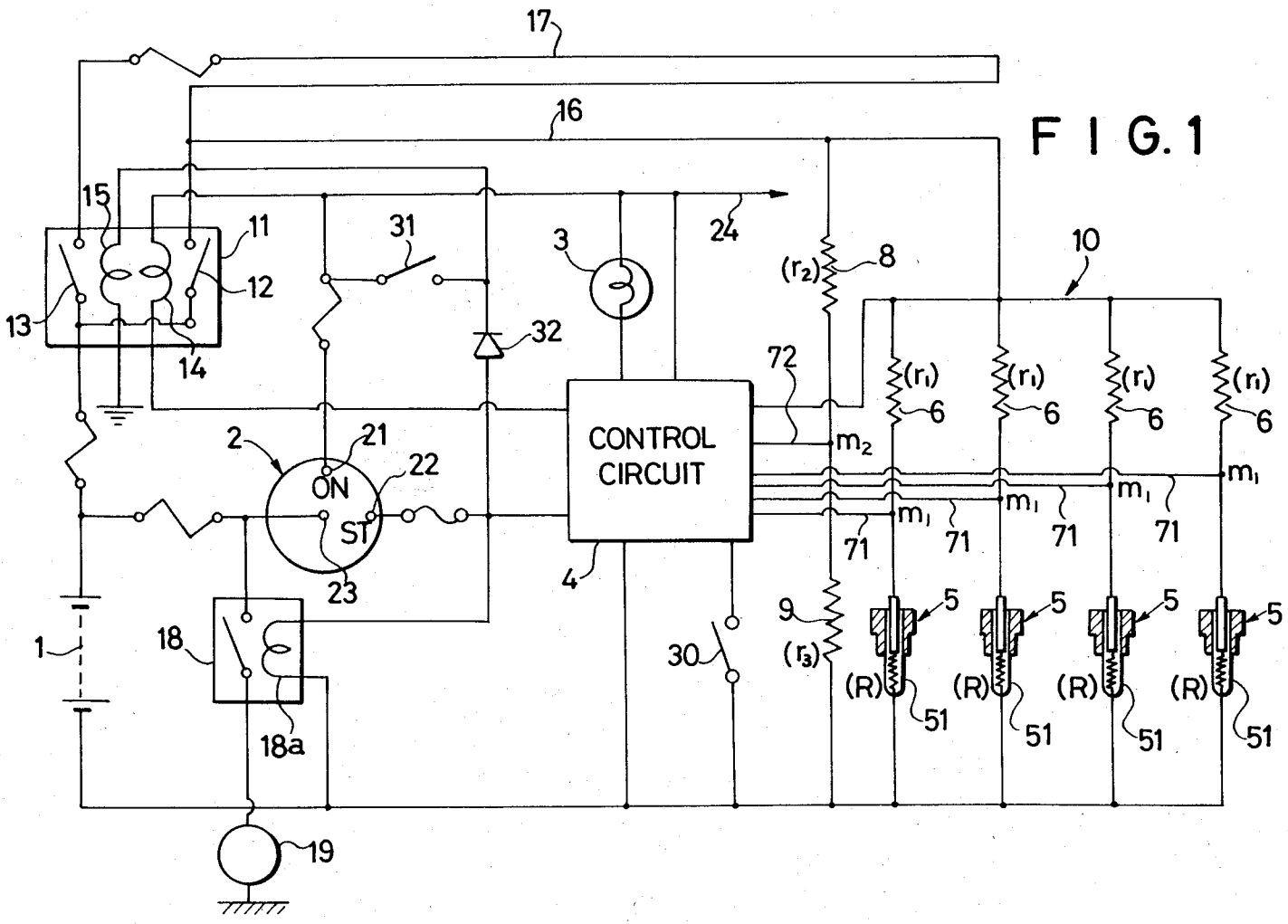
FIG. 1 is a circuit diagram of a preferred embodiment of a preheating apparatus of the present invention.

In FIG. 1, designated at 1 is a power supply in the form of a battery, and 2 a key-operated switch. The key-operated switch 2 has two fixed contacts 21, 22 and a movable contact 23 rotatable by a key 2K. The movable contact 23 is connected to the fixed contact 21 at a first step position. The movable contact 23 remains at the first step position even when the operator releases the key 2K. When the key 2K is further angularly displaced by the operator, the movable contact 23 is brought into contact with both the fixed contacts 21, 22 at a second step position. Upon release of the key 2K in the second step position, the key 2K and the movable contact 23 are urged by a spring (not shown) to return to the first step position.

Designated at 3 is a lamp for indicating that preheating plugs have reached a predetermined temperature, and 4 a control circuit. The control circuit 4 includes a comparator and a switching circuit. The detailed construction of these elements will be described below. A preheating plug 5, one of which is disposed in each of the cylinders of a diesel engine, has a heater body 51. The heater body 51 has a positive temperature coefficient and a resistance which varies with temperature, at least in the vicinity of upper and lower preheating temperature settings, and which is small enough that the heater body with melt if a rated voltage were continuously applied. A detection resistor 6 has a predetermined small resistance $r_1$. Resistors 8, 9, which have resistances $r_2$, $r_3$, are connected with the heater body 51 and the detection resistor 6 so as to form a bridge circuit 10. There are as many detection resistors 6 and preheating plugs 5 as there are engine cylinders. However, only one of each is shown in FIG. 1 for brevity of illustration.

The bridge circuit 10 has intermediate points $m_1$, $m_2$ connected to the control circuit 4 through lead wires 71, 72. Designated at 11*a* is a relay for a quick heating circuit 16, 11*b* a relay for a stabilizer circuit, 12 a contact of the quick heating circuit relay, 13 a contact of the stabilizer circuit relay, and 14, 15 exciting coils which, when energized, close the relay contacts 12, 13, respectively. The quick heating circuit 16 is connected to the contact 12 of the relay 11*a*. The stabilizer circuit 17, which is connected to the contact 13 of the relay 11*b*, includes a stabilizer resistor 17*a*. A starter relay 18 has a contact 18*b* which closes when an exciting coil 18*a* connected to the fixed contact of the key-operated switch 2 is energized. A starter 19 is actuated when the contact 18*b* of the starter relay 18 is closed.

A water temperature detecting switch 30 detects the temperature of coolant water in the vicinity of the engine cylinder. The switch 30 is closed when a detector 30*a* immersed in the coolant water detects a temperature of 50° C. or above, for example. Closing of the switch 30 is used to disable the quick heating circuit 16, a condition which is indicated by the indicator lamp 3.

A manual preheating switch 31 serves as an emergency switch which can be used if the control circuit 4 fails to operate and the engine cannot be started even by rotating the key-operated switch 2 to the starting position (the second step position). Where the manual preheating switch 31 is used, however, it will take as long a period of time as conventional preheating arrangements before the engine can be started. A diode 32 serves to prevent the starter 19 from being operated when the key-operated switch 2 is turned to the first step position.

The control circuit 4 includes a comparator 41, a normally closed relay 42 which is energized and its contact opened when a drive signal is applied from the comparator 41 and de-energized and its contact closed when an NC signal is applied upon the water temperature switch 30 being closed, a normally open relay 44 which is closed when a drive signal is applied, and an inverter 43. Resistors $r_h$ have high resistances of the order of several megohms. Designated at F are fuses, and at 24 a circuit for energizing various accessories.

Operation of the starting assistance apparatus as shown in FIG. 1 during cold weather conditions will now be described.

When the ambient temperature is sufficiently low, the water-temperature detecting switch 30 remains turned off (so long as the temperature of the engine coolant water is 50° C. or below, for instance) and hence the relay 42 is ready for operation as no NC signal is applied. When the operator turns the key 2K causing the movable contact 23 to connect to the fixed contact 21 at the first step position, the exciting coil 14 of the relay 11*a* is energized as the contact of the relay 42 in the control circuit 4 is closed, thus closing the contact 12 to allow a large current to flow from the power supply 1 through the heater body 51 of the preheating plug 5 in each engine cylinder to thereby rapidly heat the heater body 51. As the temperature of the heater body 51 increases, its resistance also increases. As long as its resistance R is smaller than a resistance $R_s$ which corresponds to a predetermined temperature setting, the potential at the intermediate point $m_1$ of the bridge circuit 10 is lower than that at the intermediate point $m_2$, and hence the comparator circuit 41 produces an output of a logic level "0". Therefore, the relay 42 remains turned off keeping the contact 12 of the relay 11*a* closed for continuously heating the heater body 51 of the preheating plug 5 with a large current. When the temperature of the heater body 51 reaches the predetermined temperature, its resistance equals the resistance $R_s$. When the resistance of the heater body 51 exceeds the resistance $R_s$ even slightly, the potential at the intermediate point $m_2$ in the bridge circuit 10 becomes lower than that at the intermediate point $m_1$, whereupon the output of the comparator 41 changes from a logic level "0" to a logic level "1". The relay 42 is now energized causing its contact to open, and thereby de-energizing the exciting coil 14 of the relay 11*a* and hence opening the contact 12. The heater body 51 is now de-energized and its temperature starts dropping. The output of the comparator 41 is also supplied to the relay 44 to turn on the latter as long as the output of the comparator 41 is a logic level "1" so as to appropriately energize the indicator lamp 3.

When the contact 12 of the relay 11*a* is opened, current is prevented from flowing into the bridge circuit 10, thereby causing the comparator 41 to again produce an output of a logic level "0". Then, the relay 42 is energized, consequently energizing the relay 11*a* and hence applying a voltage across the bridge circuit 10, whereupon the temperature of the heater body 51 is increased again. The comparator 41 subsequently again produces an output of "1", whereupon the voltage is once more removed from across the bridge circuit 10. The above make-and-break operation is repeated. During this time, the indicator lamp 3 flickers to indicate that the preheating plug has reached the starting temperature. The time interval at which the intermittent energization of the preheating plug 5 is repeated is almost entirely dependent on the time lag between energization of the exciting coil 14 and the closing of the contact 12. If it is desired to make the repetition interval slightly longer, the relay 42 can be arranged to operate on a delayed fashion.

Subsequently, the operator further turns the key 2K to bring the movable contact 23 into contact with both fixed contacts 21, 22 at the second step positions. Then, the starter relay 18 is closed by the exciting coil 18*a* to actuate the starter 19 and, at the same time, close the contact 13 of the relay 11*b*. A current now flows from the power supply 1 through the stabilizer circuit 17 to the heater body 51 of the preheating plug 5. Due to the voltage drop across the stabilizer resistor 17*a*, the heater body 51 of the preheating plug 5 is prevented from being melted but nevertheless the heater body 51 is maintained red-hot. The diesel engine can then be started by injecting fuel against the red-hot preheating plug 5. When the key 2K is in the second step position, a control voltage is applied to the relay 42 from the fixed contact 23 over a line 45 to thereby energize the relay 42 and hence disable the quick heating circuit.

When the diesel engine is started, the operator releases the key 2K, thereby allowing the key 2K and movable contact 23 to return to the first step position. At this time, the relay 11*a* is energized as described above to switch the quick heating circuit into operation. However, when the sensed temperature of the coolant water exceeds 50° C. after the engine has been started, the detector 30*a* turns on the water-temperature detecting switch 30, energizing the relay 42 to open its contact. Therefore, the quick heating circuit is maintained de-energized.

If the temperature of the coolant water continuously remains above 50° C., such as during hot weather conditions, the water-temperature detecting switch 30 is always actuated to prevent the quick heating circuit from being energized at any time.

Figure 2:
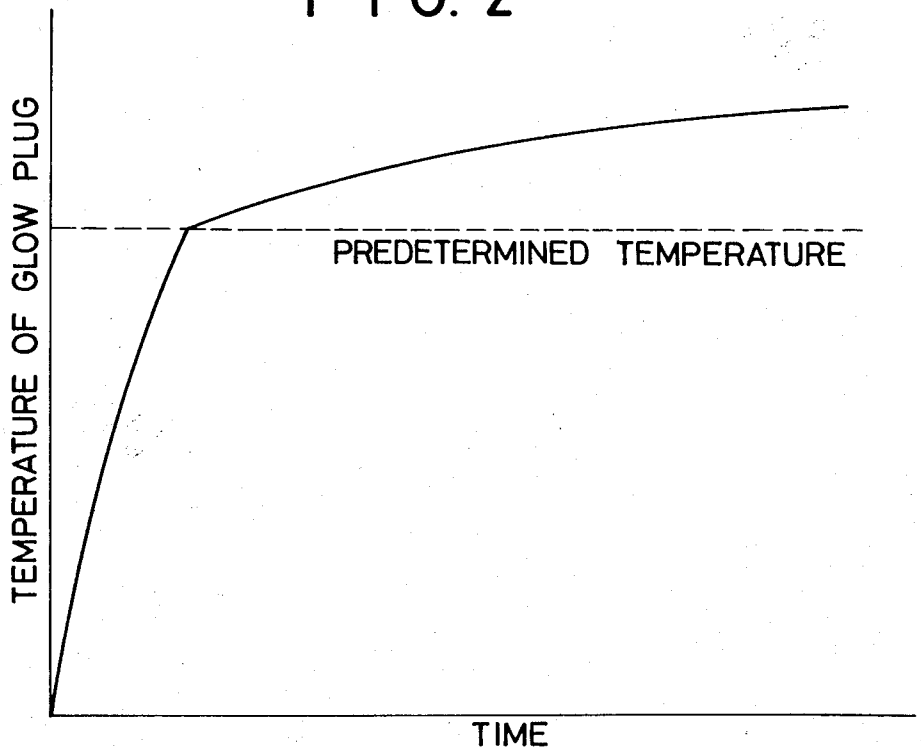
FIG. 2 is a circuit diagram showing connections for plural preheating plugs and a portion of a control circuit.

FIG. 1 shows a circuit for only a single preheating plug 5. Where the present invention is applied to a four-cylinder diesel engine, four preheating plugs 5 are necessary. In such an application, as shown in FIG. 2, four comparators 41*a* through 41*d*, which are connected to respective preheating plugs 51 through 5*d*, have output terminals connected to input terminals of an OR gate 47, the output of which is used to actuate the relay 42. For a simplified circuit, the single preheating plug 5 shown in FIG. 1 can be replaced with plural parallel preheating plugs. As a further modification, the water-temperature detecting switch 30 may be arranged to energize the stabilizer circuit at a temperature other than 50° C.

As described above in detail, the heater body of the preheating plug according to the present invention has a low thermal resistance such that it would quickly melt if a rated voltage were applied thereto continuously. With this arrangement, a large amount of electric energy can be supplied immediately upon voltage being applied to the preheating plug when the key-operated switch is set in the accessory energizing position (one step prior to the engine starting position), so that the heater body of the preheating plug can be heated to a desired preheating temperature at a speed much faster than that attainable by a conventional apparatus. There is, however, no actual danger that the heater body of the preheating plug will melt since the supply of current to the heater body is quickly cut off by the control circuit when the heater body reaches the designated temperature. After the quick heating circuit has been energized for preheating operations with the starter switch in the accessory energizing position, the starter is actuated and simultaneously the preheating plug is continuously energized with a smaller current than in the quick heating mode to thereby maintain the plug at a constant temperature. This enables the diesel engine to start immediately, even when the ambient temperature is very low.

We claim:

1. An apparatus for controlling the preheating of a diesel engine, comprising: at least one preheating plug having a heater body having a resistance variable with temperature at least in the vicinity of predetermined upper and lower preheating temperatures, said resistance of said heater body being sufficiently small that said heater body would melt if a predetermined rated voltage were continuously applied to said heater body; means for detecting when said heater body reaches said predetermined upper temperature, said detecting means including a bridge circuit having an arm in which said heater body is interposed and a control circuit including a comparator for comparing voltages of said bridge circuit; quick heating circuit means for applying, in an accessory energizing position of a starter switch, said rated voltage to said heater body when an output of said detecting means indicates that the temperature of said heater body is below said predetermined upper temperature, said quick heating circuit having a relay having a normally open contact disposed between a battery and said bridge circuit; and stabilizer circuit means for applying to said heater body, when said starter switch is in an engine starting position, a second voltage lower than said rated voltage which will not cause said heater body to be melted when said second voltage is continuously applied to said heater body, said stabilizer circuit being disposed between said bridge circuit and a battery and said stabilizer circuit including a stabilizer relay having a normally open contact and a stabilizer resistor, said normally open contact of said stabilizer relay and said stabilizer resistor being electrically connected in parallel with said normally open contact of said quick heating circuit means.

2. The apparatus for controlling the preheating of a diesel engine as claimed in claim 1, further comprising indicating lamp means operating in response to said output of said comparing means for indicating when said quick heating circuit is applying said rated voltage to said heater body.

3. The apparatus for controlling the preheating of a diesel engine as claimed in claim 1, wherein a plurality of said preheating plugs are provided, and wherein said comparing means comprises a plurality of comparators, one of said comparators being provided for each of said preheating plugs; and OR gate means receiving as inputs outputs of said comparators, said output of said comparing means being formed at an output of said OR gate means.

4. An apparatus for controlling the preheating of a diesel engine, comprising: at least one preheating plug having a heater body having a resistance variable with temperature at least in the vicinity of predetermined upper and lower preheating temperatures, said resistance of said heater body being sufficiently small that said heater body would melt if a predetermined rated voltage were continuously applied to said heater body; a first resistor connected in series with each said preheating plug; second and third resistors connected in series with each other and then in parallel with the series connection of said first resistor and said heater body, a junction point of said heater body and said third resistor being connected to a first terminal of a battery; a starter switch having a movable contact connected to a second terminal of said battery and second and third contacts corresponding, respectively, to an engine accessory energizing position and an engine starting position; a quick heating circuit relay having a normally open contact having one terminal connected to said second terminal of said battery and a second terminal connected to a junction point between said first and second resistors; a control circuit including a control circuit relay having a normally closed contact having a first terminal connected to said first terminal of said battery and a second terminal connected to a first terminal of an energizing coil of said quick heating circuit relay, a second terminal of said quick heating circuit relay being connected to said second contact of said starter switch, a comparator having a first comparison input terminal connected to a junction point between said first resistor and said heater body and a second comparison input terminal connected to a junction point between said second and third resistors, an energizing coil of said control circuit relay being coupled to an output of said comparator and said third contact of said starter switch such that, when said starter switch is not in said engine starting position and said output of said comparator is in a state corresponding to a voltage at said junction between said first resistor and said heater body being less than a voltage at said junction point between said second and third resistors, said contact of said control circuit relay is closed to thereby energize said energizing coil of said quick heater relay and thereby connect said heater body to said battery through said first resistor, and wherein when said starting switch is in said starter position or said output of said comparator is in a state indicative of said voltage at said junction between said first resistor and said heater body is greater than said voltage at said junction between said second and third resistors, said contact of said control circuit relay is open to thereby de-energize said exciting coil of said quick heating circuit relay and thereby open said contact of said quick heating circuit relay; a stabilizer circuit including a stabilizer relay and a stabilizer resistor, a normally open contact of said stabilizer circuit relay being connected in series with said stabilizer resistor and the series connection of said contact of said stabilizer circuit relay and said stabilizer resistor being connected between a junction of said first and second resistors and said second terminal of said battery, an exciting coil of said stabilizer circuit relay having a first terminal connected to said first terminal of said battery and a second terminal connected through a diode to said third contact of said starter switch, wherein when said starter switch is in said starter position, said contact of said stabilizer circuit relay is closed to connect said heater body to said battery through said first resistor and said stabilizer resistor.

5. The apparatus for controlling the preheating of a diesel engine of claim 4, further comprising a coolant temperature sensor for sensing a coolant temperature of said engine, said coolant temperature sensor being coupled to said energizing coil of said control circuit relay for opening said contact of said control circuit relay when the coolant temperature of said engine is above a predetermined limit temperature.

6. The apparatus for controlling the preheating of a diesel engine of claim 4, further comprising a manual preheating switch connected between said second contact of said starter switch and said second terminal of said exciting coil of said stabilizer circuit relay.

7. The apparatus for controlling the preheating temperature of a diesel engine of claim 4, wherein said control circuit further comprises an indicator lamp, and an indicator lamp relay, said indicator lamp being connected in series with a normally open contact of said indicator lamp relay and the series connection of said indicator lamp and said normally open contact of said indicator lamp relay being connected between said first terminal of said battery and said second contact of said starter switch, an energizing coil of said indicator lamp relay being coupled to be operated in accordance with an output of said comparator for driving said lamp when said contact of said quick heating circuit relay is closed.

8. The apparatus for controlling the preheating of a diesel engine of claim 5, wherein a plurality of said preheating plugs is provided, and wherein one said comparator is provided for each of said preheating plugs, and further comprising an OR gate having inputs connected to respective outputs of each of said comparators, an output of OR gate forming said output of said comparator circuit.

* * * * *